US008006605B2

(12) United States Patent
Tunis et al.

(10) Patent No.: US 8,006,605 B2
(45) Date of Patent: Aug. 30, 2011

(54) ARMOR PANEL SYSTEM

(75) Inventors: George C. Tunis, Berlin, MD (US); Scott Kendall, Berlin, MD (US)

(73) Assignee: Hardware, LLC, Pocomoke, MD (US)

( * ) Notice: Subject to any disclaimer, the term of this patent is extended or adjusted under 35 U.S.C. 154(b) by 993 days.

(21) Appl. No.: 11/973,888

(22) Filed: Oct. 10, 2007

(65) Prior Publication Data

US 2009/0095147 A1 Apr. 16, 2009

(51) Int. Cl.
*F41H 5/02* (2006.01)
*B32B 3/06* (2006.01)

(52) U.S. Cl. ..... 89/36.02; 89/910; 89/912; 89/36.01; 428/102; 428/193

(58) Field of Classification Search ..... 89/36.01, 89/36.02, 36.04, 36.05, 36.07, 908, 909, 89/910, 912, 913, 914; 112/104; 428/102, 428/193, 194
See application file for complete search history.

(56) References Cited

U.S. PATENT DOCUMENTS

| | | | | |
|---|---|---|---|---|
| 1,359,062 | A * | 11/1920 | Hawkins | 24/695 |
| 1,871,101 | A | 8/1932 | Waltz | |
| 3,859,892 | A | 1/1975 | Coes | |
| 5,007,326 | A | 4/1991 | Gooch, Jr. et al. | |
| 5,196,252 | A * | 3/1993 | Harpell | 428/102 |
| 5,340,633 | A | 8/1994 | van der Loo et al. | |
| 5,686,689 | A | 11/1997 | Snedeker et al. | |
| 2005/0193667 | A1 | 9/2005 | Henry et al. | |
| 2006/0065111 | A1 | 3/2006 | Henry | |
| 2007/0089597 | A1 | 4/2007 | Ma | |
| 2011/0041676 | A1 * | 2/2011 | Park et al. | 89/36.02 |

FOREIGN PATENT DOCUMENTS

WO WO 2005/098343 10/2005

* cited by examiner

*Primary Examiner* — Michael Carone
*Assistant Examiner* — Daniel Troy
(74) *Attorney, Agent, or Firm* — Weingarten, Schurgin, Gagnebin & Lebovici LLP

(57) ABSTRACT

An armor panel system has a strike face assemblage formed of a hard material layer of discrete elements or tiles and a fiber reinforcement bonded to the tiles. The fiber reinforcement includes a layer of cup-shaped staples aligned and bonded to an inner surface of an associated tile and having legs that extend into gaps between side edges of adjacent tiles. The tiles and fiber reinforcement are encapsulated in a matrix material. The armor panel system also includes a support and containment assemblage having a support plate and a containment element. The containment element is fastened to and supported by the support plate along a periphery by stitching, which allows the containment element to act as a net to catch and contain fragments. A bonding layer joins the strike face assemblage and the support and containment assemblage. The bonding layer includes a mesh embedded in an adhesive material.

14 Claims, 12 Drawing Sheets

ARMOR PANEL SYSTEM

STATEMENT REGARDING FEDERALLY SPONSORED RESEARCH OR DEVELOPMENT

This invention was made under DARPA Contract HR-0011-06-9-008. The Government may have certain rights in this invention.

CROSS REFERENCE TO RELATED APPLICATIONS

N/A

BACKGROUND OF THE INVENTION

Ballistic and blast resistant panels are well known and take on a variety of configurations for providing armor to buildings, vehicles, ships, airplanes and a variety of other applications where armor is required. Armor should be both ballistic resistant and blast resistant. In addition to typical projectiles, it is also desirous to stop high velocity armor piercing weapons.

Traditional armor is commonly solid metallic armor made of steel, aluminum, titanium or alloys thereof. Such solid metallic armors typically possess excellent stopping power. However, the steel and aluminum metallic armor has several drawbacks, including low weight efficiency compared to composite systems. Titanium systems typically perform better than steel and aluminum, but titanium is expensive. Although solid metal armor does have excellent multi-hit characteristics, metal armor often creates fragment projectiles on the backside of the armor that cause additional dangers. Such fragments may be widely dispersed from the solid armor and can be as dangerous or more dangerous than the initial, primary projectile.

To overcome such shortcomings, composite armors have been developed that are highly weight efficient, offering improved projectile and fragment stopping power per weight as compared to solid metal armors. However, composite armors based on ceramic strike faces with composite backing plates have typically included carbon, glass and aramid polymer composites, which are expensive. Moreover, since manufacturing processes for the ceramic strike faces are slow and power intensive, the resulting armor can be in short supply. Backing plates have heretofore utilized traditional fibers, typically at diameters less than 100 microns. Such fine diameter fibers for low cost, stiff and high elongation thermoplastic polymer systems have limited use, due to the inability to adequately wet the fibers at required high fiber volumes.

Innovations in reinforcements have been made utilizing ultra high strength twisted steel wires. See, for example, U.S. Pat. Nos. 7,144,625 and 7,200,973. Such material, made under the trade name HARDWIRE®, affords users the ability to use material that may be eleven times stronger than typical steel plate as reinforcement for many different materials. The HARDWIRE® material functions as a moldable, high strength steel. The material may be molded into thermo-set, thermoplastic or cementitious resin systems. The HARDWIRE® material can be used to upgrade steel, wood, concrete, rock or other materials and may be retrofit for some applications. Moreover, the inexpensive HARDWIRE® material is typically priced like a glass material, while performing like carbon composites. In addition, such composites may typically be up to 70% thinner and 20% lighter than composites made with glass fibers. The material may be molded so that it can be applied to multiple shapes for various applications.

An armor panel system having a hardened strike face and reinforced backing panel is described in WO 2005/098343. In this system, the hardened strike face may be a material having a high hardness, such as granite, hardened concrete or ceramic tile. The hardened strike face acts to flatten or shatter the projectile and a cone of pulverized material is spread through to the backing panel. The backing panel absorbs and spreads out the material and supports the strike face to resist dilation for improved multi-hit performance. The reinforced backing panel utilizes reinforcement materials having high strength and stiffness, such as the HARDWIRE® material, to provide support to the strike face upon impact. The reinforcement backing may be provided in unidirectional layers that are oriented at, for example, 90° to one another. Staples may extend through the layers to provide additional resistance against delamination.

SUMMARY OF THE INVENTION

An armor panel system has a strike face assembly and a support and containment assemblage joined by a bonding layer. The strike face assemblage is formed of a hard material layer, which may be comprised of discrete elements or tiles, and a fiber reinforcement bonded to an inner and/or outer surface of the hard material layer. In one embodiment, the fiber reinforcement includes a layer or layers of cup-shaped staples aligned and bonded to an inner surface of an associated tile and having legs that extend into gaps between side edges of adjacent tiles. The tiles and fiber reinforcement are encapsulated in a matrix material. Additional outer and inner layers of reinforcement may be added.

The support and containment assemblage includes in one embodiment a support plate and a containment element. The containment element is preferably formed of a composite laminate of ultra high molecular weight polyethylene fibers embedded in a matrix material. The containment element is fastened to and supported by the support plate along a periphery by stitching, which allows the containment element to bulge and act as a net to catch and contain fragments.

The bonding layer joins the strike face assemblage to the support and containment assemblage. The bonding layer includes in one embodiment a mesh embedded in an adhesive material that minimizes or prevents crack propagation through the bonding layer.

DESCRIPTION OF THE DRAWINGS

The invention will be more fully understood from the following detailed description taken in conjunction with the accompanying drawings in which.

DETAILED DESCRIPTION OF THE INVENTION

Figure 1:
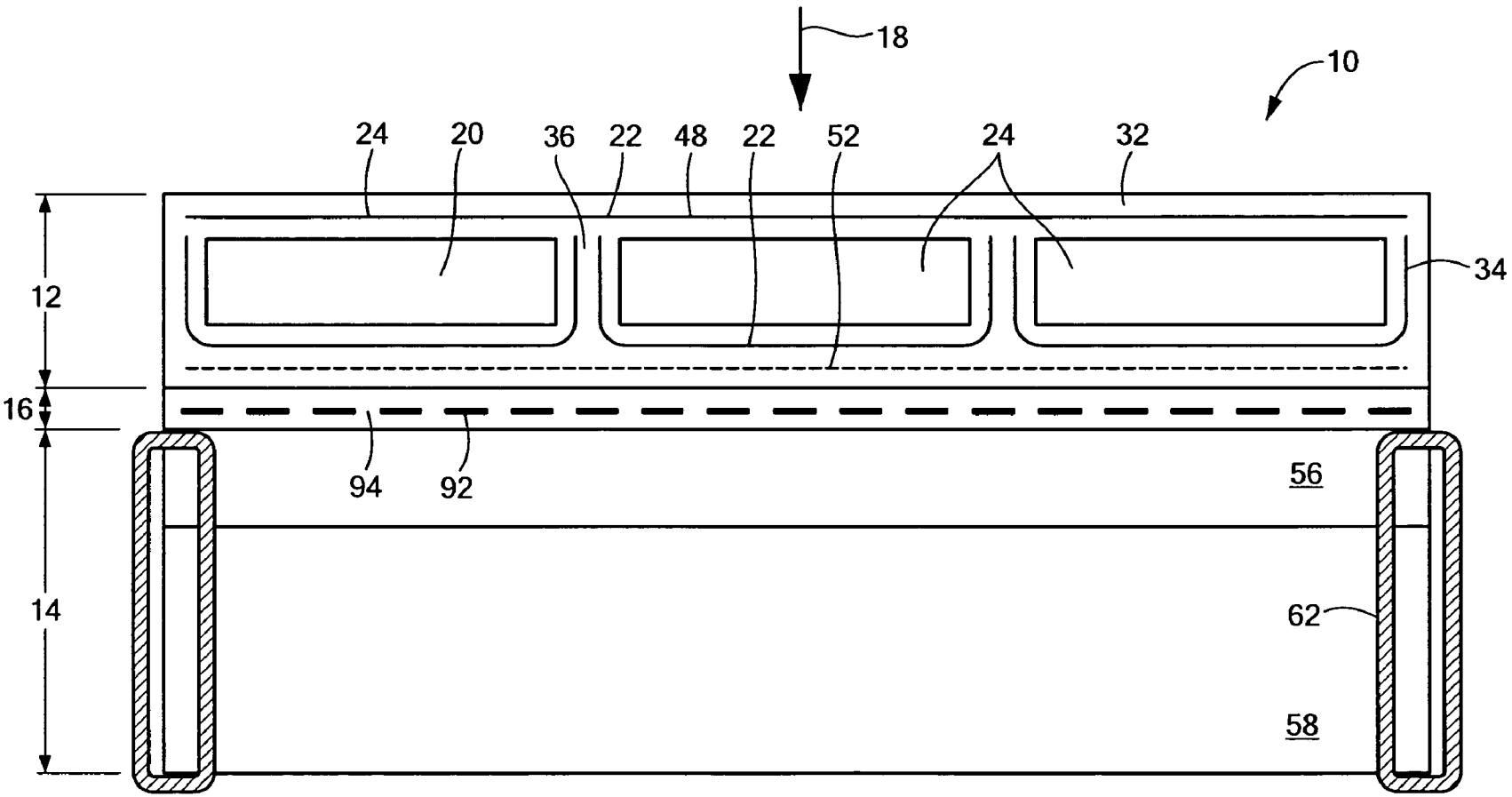
FIG. 1 is a schematic side view of an armor panel system of the present invention.

Referring to FIG. 1, an armor panel system 10 incorporates a strike face assemblage 12 and a support and containment assemblage 14 joined by a bonding layer 16. The support and containment assemblage 14 supports the strike face assemblage 12 and catches and contains pulverized material from the shattering of both an incoming projectile impacting the armor panel system and the armor panel system itself. In use, the armor panel system is oriented with the strike face assemblage 12 facing outwardly toward the direction of an incoming projectile (indicated by arrow 18). The strike face assemblage shatters the projectile and a cone of pulverized material spreads through to the support and containment assemblage. The support and containment assemblage deforms or bulges inwardly while remaining attached along a periphery, acting as a net to capture the pulverized material, discussed further below.

The strike face assemblage 12 is formed of material 20 having a high hardness bonded to a fiber reinforcement 22. The hard material 20 typically is formed of discrete elements or tiles 24 having outer and inner surfaces 26, 28 and side edges 30. The tiles are arranged with their side edges 30 contiguous to form a surface, which could be planar, faceted, or curved. The fiber reinforcement is bonded via a matrix material 32 to both the outer and inner surfaces of the tiles and within gaps between the tiles, encapsulating the tiles and fiber reinforcement.

Figure 2:
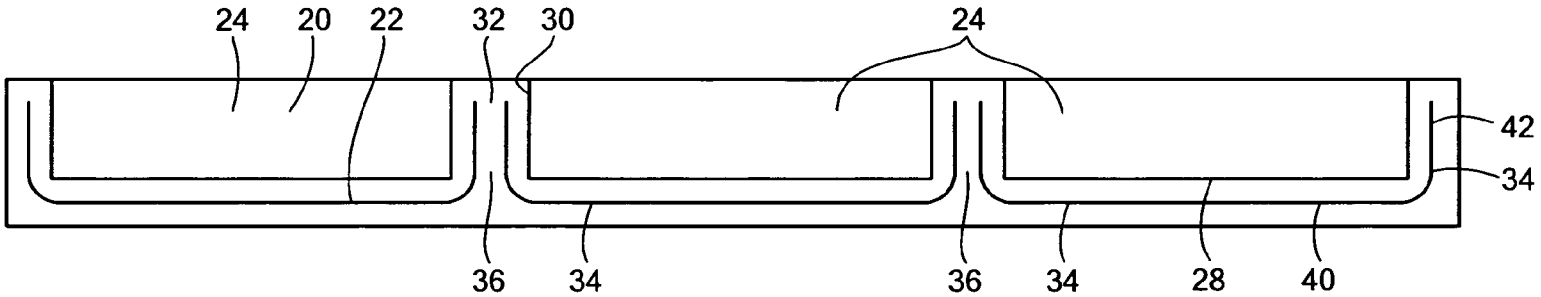
FIG. 2 is a schematic side view of a strike face assemblage of the armor panel system of FIG. 1.
Figure 3:
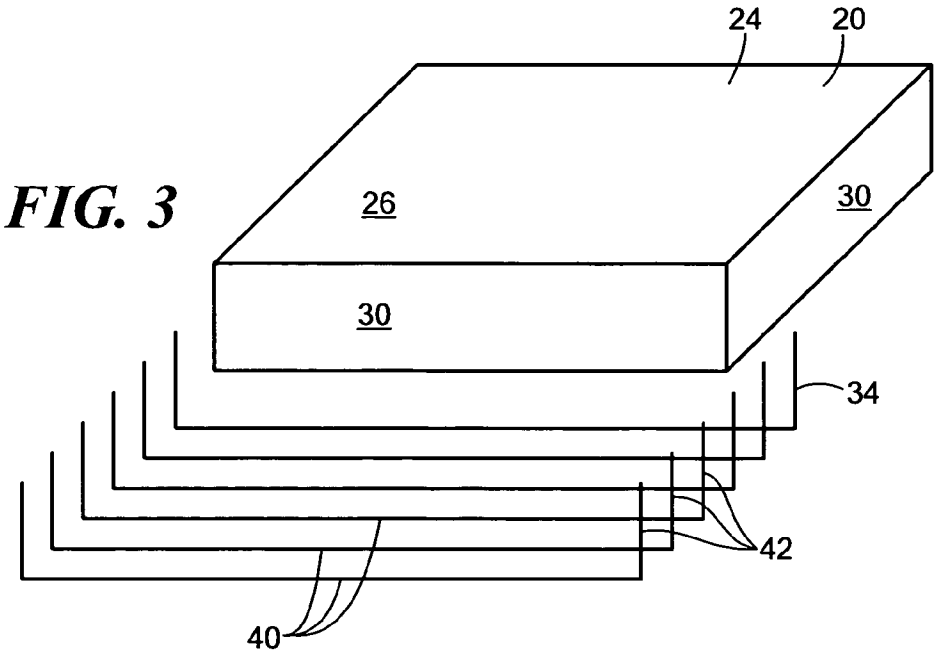
FIG. 3 is an exploded view of a portion of the strike face assemblage of FIG. 2, illustrating the fiber reinforcement in the form of cup-shaped staples.
Figure 4:
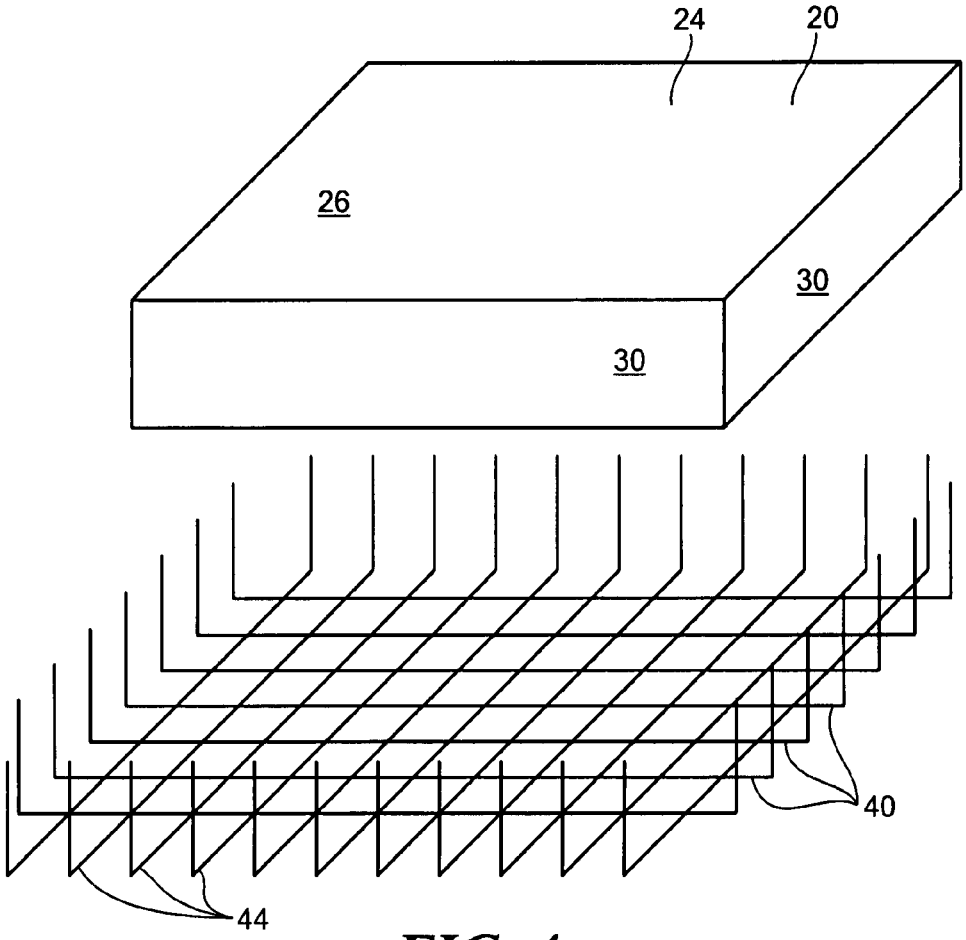
FIG. 4 is an exploded view of a portion of the strike face assemblage illustrating a further layer of cup-shaped staples.

The fiber reinforcement 22 includes an underlying or inner side reinforcement layer 34 bonded to the inner surfaces or undersides 28 of each of the tiles 24 and wrapped around and up at least one side 30 of each tile to extend into the gaps 36 between each of the tiles. This reinforcement layer adds to the tensile capability of the strike face and resists delamination and crack propagation. In the embodiment illustrated (see FIGS. 2 and 3), the underlying reinforcement layer 34 is formed from a plurality of cup-shaped staples 40 placed in a parallel arrangement in a layer adjacent the inner surface 28 of each tile and having legs 42 extending at least partially up opposed sides 30 of each tile. Preferably, a second layer of staples 44 is provided oriented at an angle to the first layer of staples 40. (See FIG. 4.) For square or rectangular tiles, two layers oriented at 0° and 90°with respect to each other on the inner side of the tile provide sufficient coverage of the surface area of the tile. More layers of staples may be provided as desired. For example, for hexagonal tiles, three layers of staples may be needed to provide sufficient coverage over the inner surface. Suitable fiber materials include without limitation HARDWIRE® fibers, aramid fibers, carbon fibers, E-glass fibers, and S-glass fibers.

Figure 16A:
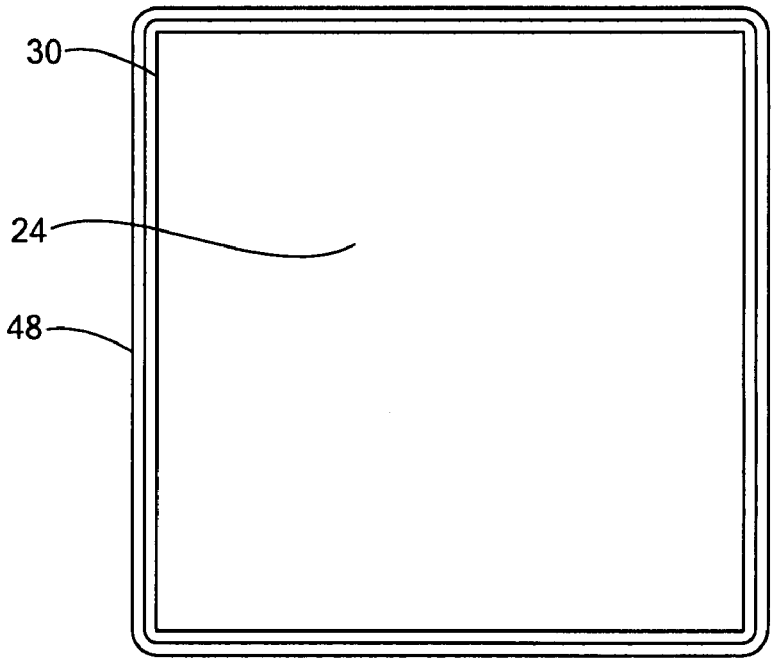
FIGS. 16A and B is a top view of square and hexagonal strike face tiles illustrating fiber reinforcement wrapping their perimeters.
Figure 16B:
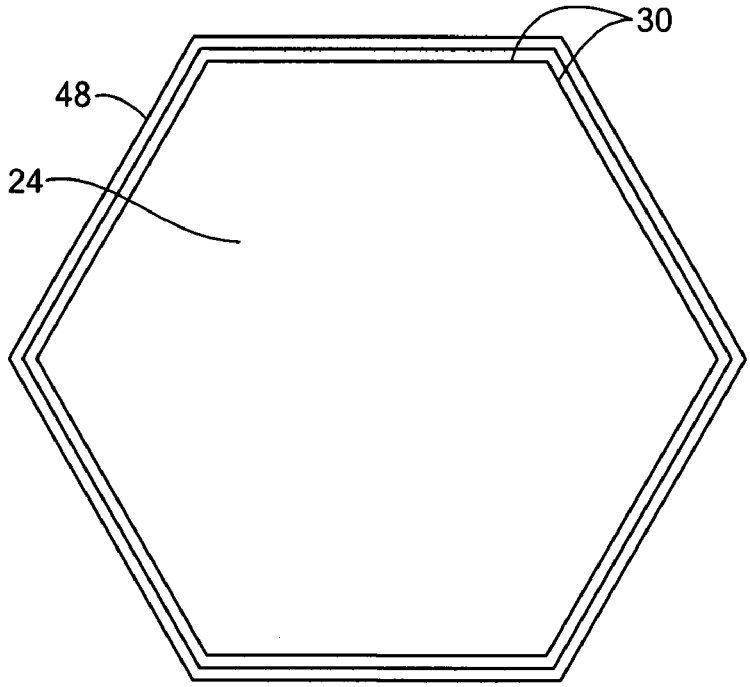

In one embodiment, the underlying reinforcement layer is readily fabricated by using HARDWIRE® unidirectional tape, in which twisted metal wires are embedded in a linear alignment in a resin. The tape is cut into sections of a suitable length. The sections of the tape are bent or cupped to form the staple legs for two of the tile sides and placed adjacent the inner side of the tile, thereby covering the inner surface and two sides in one step. A second layer of staples is then preferably arranged transverse or 90° to the first layer of staples. The spacing of the staples in a layer is suitably between 1 and 50 staples per inch. Such an arrangement contains the hard tile fragments after impact and prevents cracks from propagating to adjacent tiles. In a further embodiment, the tiles can be wrapped on the inner surface and the sides with a woven fiber fabric. If the tiles have other than four sides, any suitable number of layers of staples may be used to cover all of the surface area on the inner surface of the tiles and the sides of the tile. In another embodiment, tiles 24 are wrapped around the perimeter with reinforcing fibers or wire 48 before being assembled into a continuous surface. See FIGS. 16A and B. This is still effective at containing the tile on impact, but is less effective than the staples at stopping delamination from one tile to the next. The perimeter fiber reinforcement wrapping can also be used in addition to other fiber reinforcement.

An overlying or outer surface reinforcement layer 48 or layers are also provided over the outwardly facing surface 26 of the tiles 24 to contain fragments of the tiles after an impact. The overlying reinforcement layer(s) further helps hold the tiles in place during the manufacturing process, such as a pultrusion process. The overlying reinforcement layers may suitably be formed of unidirectional fiber tape laid in alternating 0° and 90°layers. The overlying reinforcement layer(s) may be formed of any suitable fiber material, such as, without limitation, HARDWIRE®fibers, aramid fibers, carbon fibers, E-glass fibers, and S-glass fibers.

An additional inner reinforcement layer(s) 52 may be provided on the inner side 28 of the tiles 24, beneath the underlying reinforcement 34 or staples, to aid in holding the tiles in place during manufacture, such as in a pultrusion process. The additional inner reinforcement layer(s) may be formed of any suitable material, such as HARDWIRE® fibers, aramid fibers, carbon fibers, E-glass fibers, and S-glass fibers.

As noted above, the tiles, staples, and overlying and underlying reinforcement layers are embedded in a matrix material 32 that holds the components together. The gaps 36 between the tiles are also filled with the matrix material. Suitable matrix materials include, without limitation, thermoset, epoxy, unsaturated polyester, urethane, phenolic, or methacrylate-based plastic resins. Other suitable resins for the matrix material include thermoplastic, polypropylene, polyethylene, polycarbonate, polyvinylchloride, polyesters including polyethylene terephthalate and polybutylene terephthalate, polyetherimide, polyetheretherketone, acrylic, and polystyrene.

Figure 5:
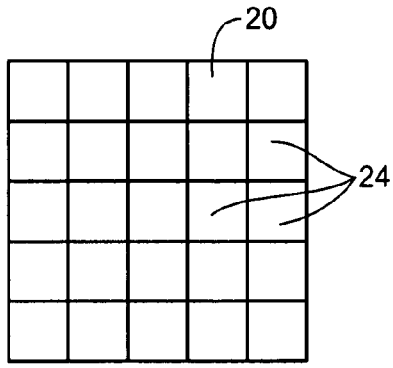
FIG. 5 illustrates one pattern of tiles of the strike face assemblage.
Figure 6:
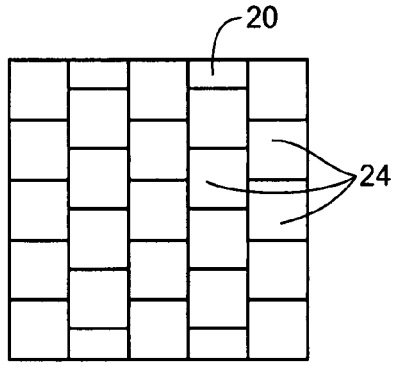
FIG. 6 illustrates a further pattern of tiles of the strike face assemblage.

The tiles 24 can be arranged in any suitable pattern, as indicated in FIGS. 5 and 6. A staggered pattern, as shown in FIG. 6, is preferred so that no four corners meet together at one point. Such a pattern assists in avoiding weak spots. The tiles can be formed of any suitably hard material, such as, without limitation, ceramic, silicon carbide, alumina, boron carbide, or granite or other stone. Hexagonal or other shapes can be used. The tiles may be of limited size because of manufacturing constraints, as in the case of ceramics, or natural limitations, as in the case of quarried granite or other stone. In one suitable embodiment, square 4"×4" ceramic tiles having a thickness of 12 mm are used.

Figure 7A:
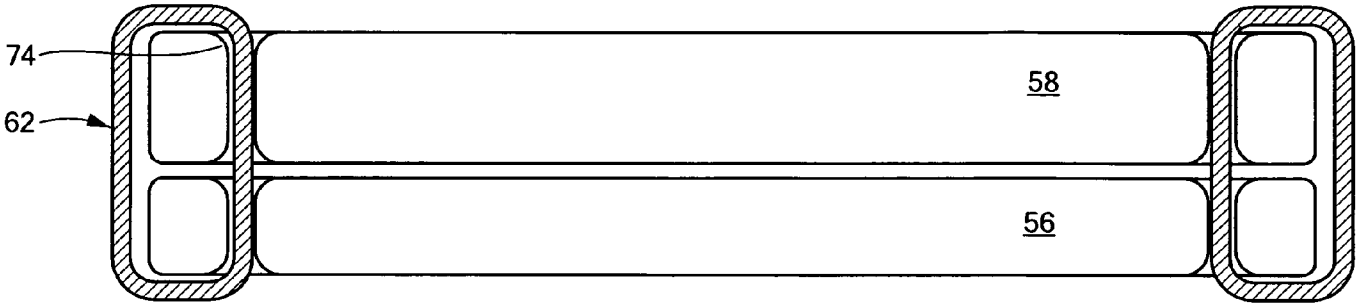
FIGS. 7A, 7B, and 7C illustrate a support and containment assemblage of the armor panel system of FIG. 1 upon impact by a projectile.
Figure 7B:
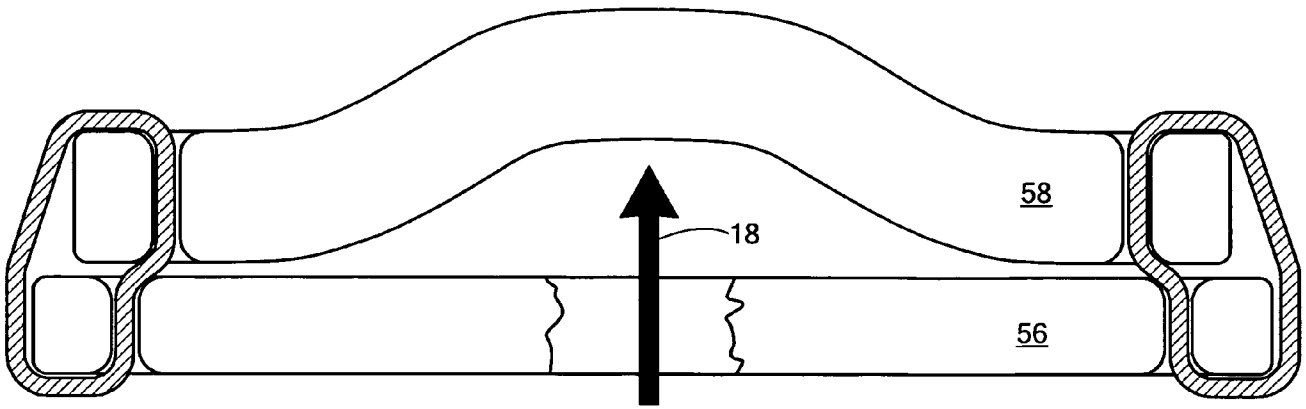
Figure 7C:
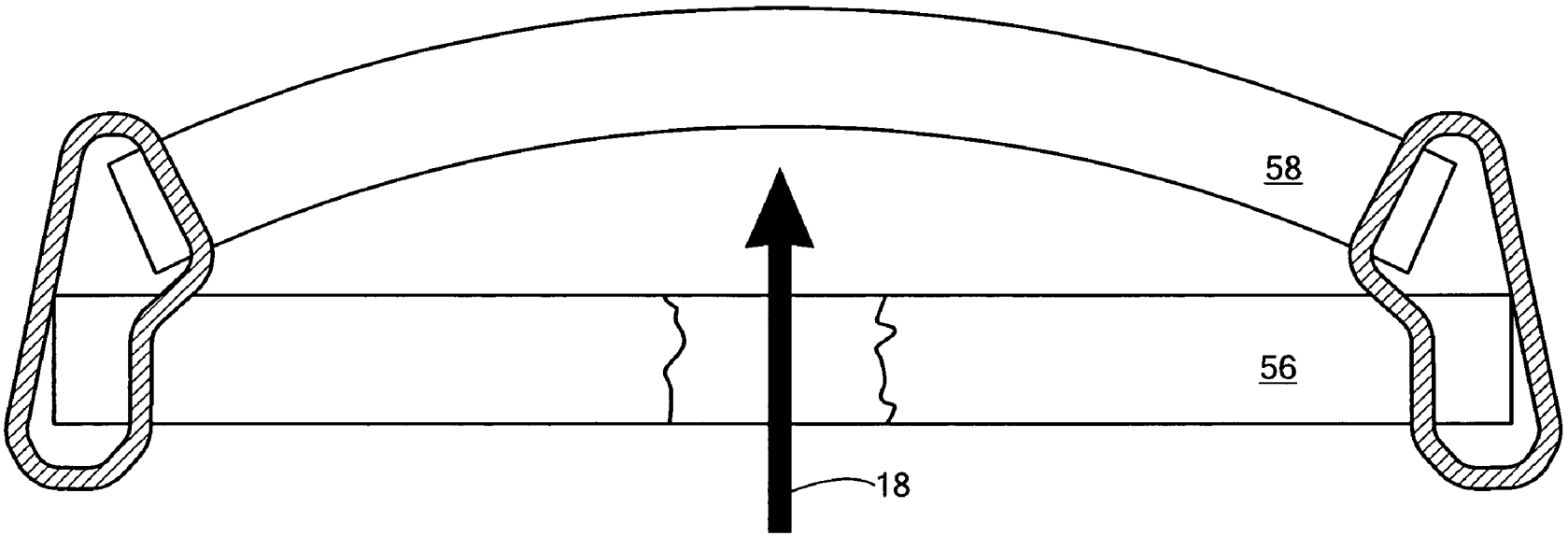

Referring again to FIG. 1, the support and containment assemblage 14 is formed of a support plate 56 and a containment element 58, such as a composite laminate. The support plate and the containment element are fastened together around the entire periphery of the support and containment assemblage, preferably by stitching 62. When the panel is impacted with a projectile, the fastening or stitching allows the containment element to undergo large deflections, going into a state of membrane stress, while remaining attached at the edges to the support plate, like a net, and capturing fragments therein (discussed further below). See FIGS. 7A-C.

The support plate 56 serves as an intermediate ballistic energy absorbing panel between the strike face assemblage 12 and the containment element 58. The support plate also supports the strike face assemblage and serves as a frame for supporting the containment stitching 62 attaching the support plate to the containment element. The support plate can also provide attachment points for hardware. The support plate can be formed from any suitable material, such as a metal or a composite material. Metals such as aluminum (of various grades, 7075, 6061, or 5083 and tempers), titanium, or steel are suitable.

The containment element 58 is preferably a laminate of a fiber reinforced composite material formed of multiple layers arranged with the fibers aligned in multiple directions. The fibers may be embedded in a matrix material in any suitable manner, such as unidirectional or woven. Suitable resins for the matrix material include, without limitation, thermoplastic, polyurethane, polypropylene, polyethylene, polycarbonate, polyvinylchloride, polyesters including polyethylene terephthalate and polybutylene terephthalate, polyetherimide, polyetheretherketone, acrylic, and polystyrene, and thermoset epoxy, unsaturated polyester, urethane, and phenolic.

In a preferred embodiment, the composite laminate is formed of ultra high molecular weight (UHMW) polyethylene fibers embedded in a matrix of thermoplastic polyurethane. The polyethylene has a molecular weight of typically 2 to 6 million. DYNEEMA® available from DSM or SPECTRA® available from Allied Signal are suitable.

Figure 8:
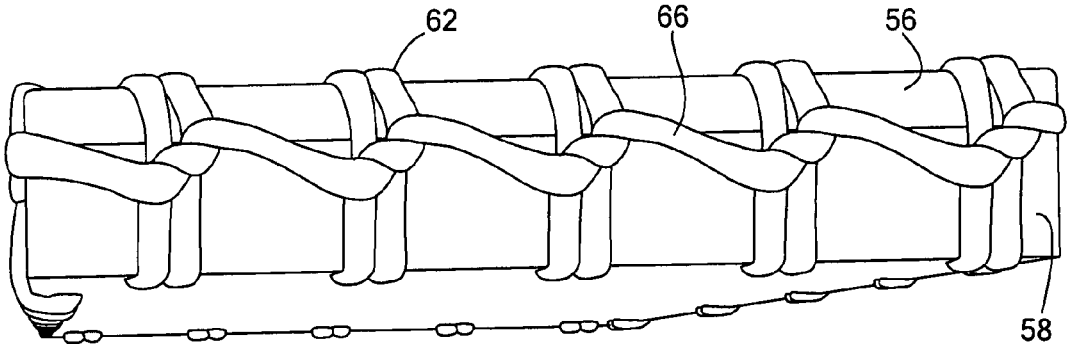
FIG. 8 is a side view of stitching of the support and containment assembly, illustrating one embodiment of a stitching pattern.
Figure 9:
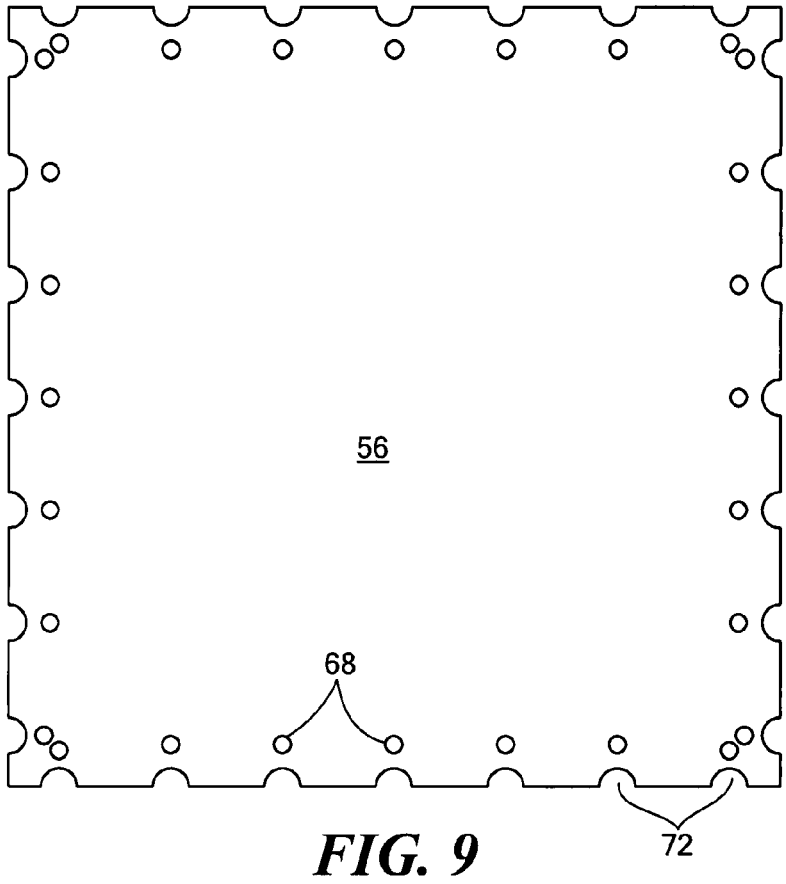
FIG. 9 is a top view of a support plate of the support and containment assembly.

As noted above, the support plate 56 and the containment element 58 are fastened together about their perimeter, preferably by stitching 62. The stitching 62 is formed of a fiber material formed into a rope or cord 66 and knotted or otherwise threaded through openings or holes 68 formed in the support plate and the containment element. See FIGS. 8 and 9. Preferably, indentations or notches 72 are also cut in the sides of the support plate and containment element to receive the stitching. The stitching holes and indentations have rounded edges 74 on one or both sides, to prevent or minimize fraying or severing of the stitching. See FIG. 7A. The stitching can be accomplished using any suitable knot or combination of knots. For example, a half hitch, multiple half hitches, and X patterns 76 (FIG. 10) can be used. In one embodiment, the stitching uses a single piece of rope or cord to extend around the entire periphery. Alternatively, multiple ropes or cords can be used. For example, from 1 to 20 ropes or more may be used per stitch hole. In a further embodiment, each set of holes (one in the support plate in alignment with one in the containment element) may have its own piece or pieces of rope, secured by a knot or knots. Also, one piece of rope can be used for multiple hole sets, from two hole sets to all of the hole sets.

The stitching is preferably formed of a cord of ultra high molecular weight polyethylene fibers. DYNEEMA® brand available from DSM or SPECTRA® brand available from Allied Signal are suitable. Other suitable materials include, without limitation, aramid, such as KEVLAR®, lower molecular weight polyethylene, or nylon.

Figure 10:
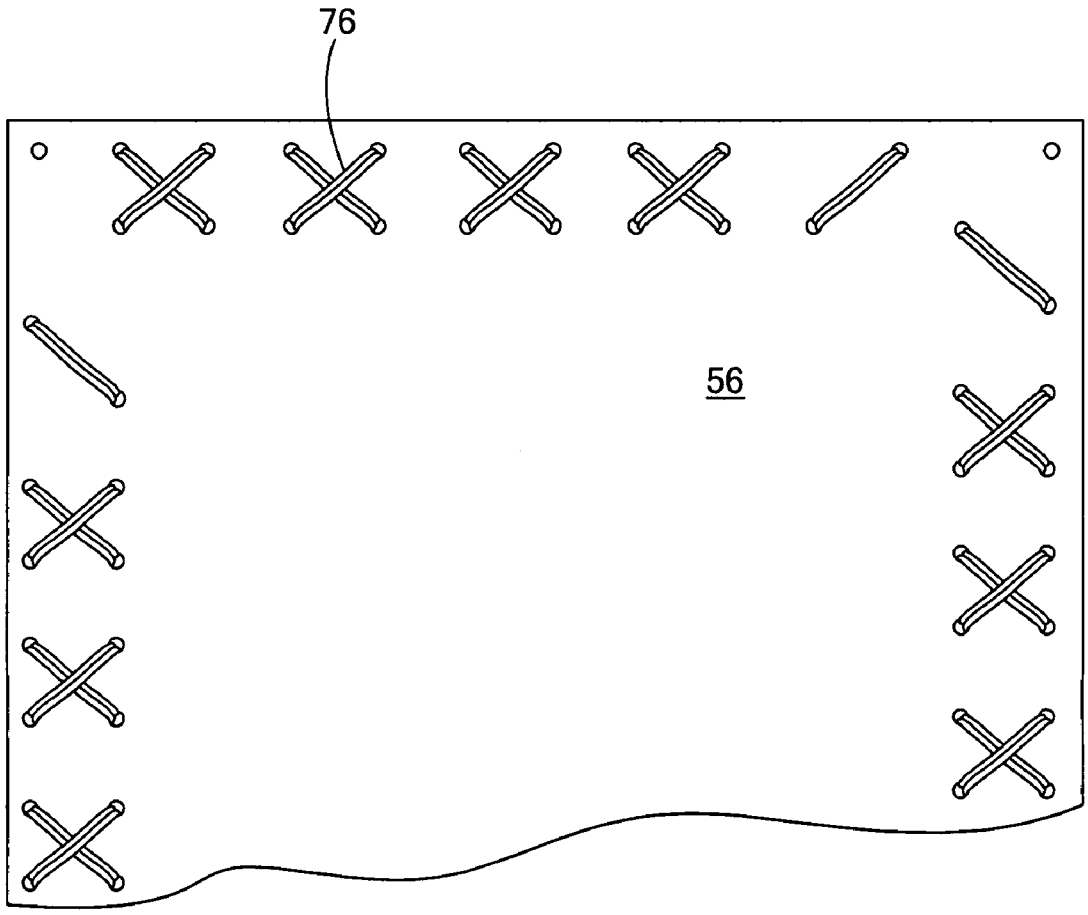
FIG. 10 is a top view illustrating a further embodiment of a stitching pattern.
Figure 11:
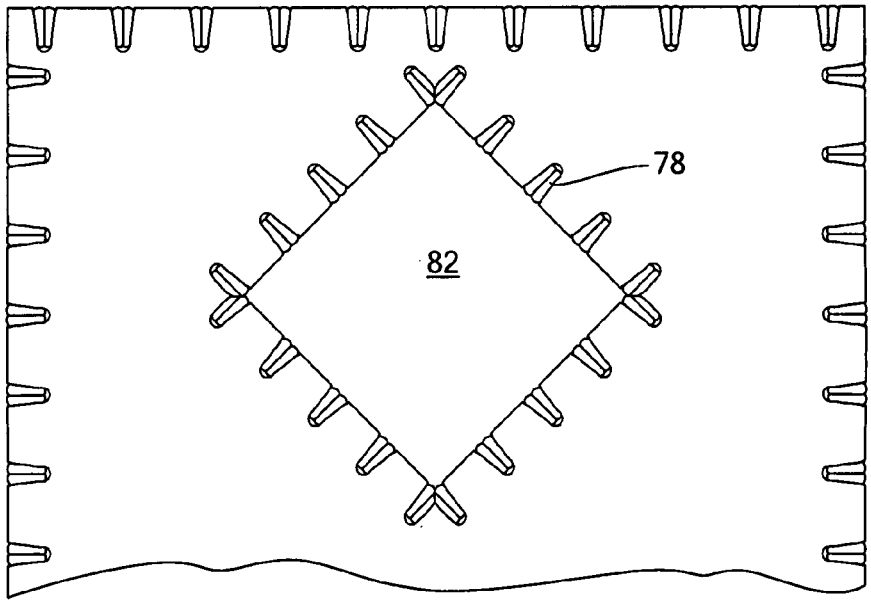
FIG. 11 is a top view illustrating interior stitching surrounding an opening in the support and containment assemblage.

If the armor panel system is particularly large, the stitching can alternatively or in addition be placed within the perimeter, for example, using the X-shaped pattern 76 through aligned holes in the support plate and containment element, illustrated in FIG. 10. Also, additional intermittent connections 78 interior to the periphery can be provided. See FIG. 11. These interior connections may be provided in the vicinity of, for example, a window opening 82.

Suitably, the support plate 56 may be between 0.25 and 1.0 inch thick. In one embodiment, the support plate is 0.5 inch thick, and the composite laminate 58 is 1.6 inch thick. The diameter of the stitching rope may be 0.10 to 0.75 inch. The hole spacing may be 0.5 to 6.0 inches. The holes may be spaced 0.25 to 5 inches from the edge of the panel. The hole diameter may be 0.125 to 1.0 inch. The rounding radius of the holes may be between 0.05 and 1 inch. It will be appreciated that these dimensions are merely exemplary, and other suitable dimensions may be provided depending on the particular application and materials.

The bonding layer 16 bonds the strike face assemblage 12 to the support and containment assemblage 14. See FIGS. 1 and 12. The bonding layer is preferably formed of a mesh 92 (shown schematically in FIG. 1) embedded in a matrix material 94, such as a methacrylate-based adhesive. The thickness of the bonding layer is preferably set by the thickness of the mesh. See FIG. 12. Thus, portions of the mesh are exposed on the inner and outer surfaces 96, 98 of the bonding layer. In this way, the thickness of the bonding layer can be readily controlled during manufacture. During manufacture, the mesh, which may have between 5% and 99% open area, promotes flow of the adhesive across the entire bonding layer.

Figure 12:
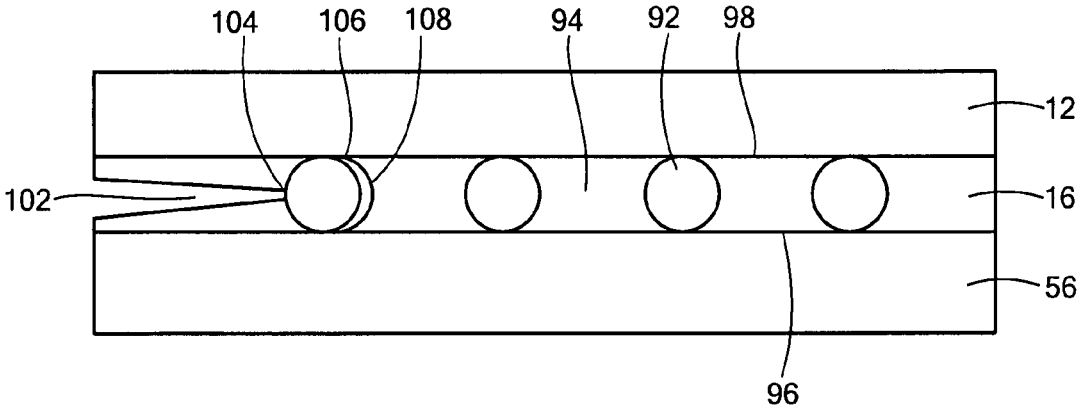
FIG. 12 is a schematic illustration of a bonding layer of the armor panel system of FIG. 1.

In use, the mesh impedes delamination of the layers by interrupting crack growth. Referring to FIG. 12, a crack 102 propagating in the bonding layer encounters a portion 104 of the mesh at a location 106 after only a short distance. The mesh de-bonds from the adhesive. The crack is inhibited from further propagation by a blunt or rounded crack tip 108 created by the molding of the adhesive around the mesh.

Preferably, the mesh is formed of a thermoplastic material. Suitable thermoplastics include, without limitation, polyethylene (PE), low density polyethylene (LDPE), high density polyethylene (HDPE), polypropylene (PP), or polyvinyl chloride (PVC). The mesh can also be metallic, such as, without limitation, stainless steel, carbon steel, galvanized carbon steel, brass, or copper. The bonding matrix material can be a thermosetting resin, such as, without limitation, epoxy, unsaturated polyester, or methacrylate-based adhesives.

The thickness of the bonding layer 16 is preferably between 0.5 and 10 mm, although thicknesses outside this range can be used. If the bonding layer is too thin, the bonding layer may become too brittle or the matrix material may squeeze out during manufacture. If the bonding layer is too thick, the bond may become too weak. Thus, those of skill in the art can readily determine an appropriate thickness for the bonding layer.

In another embodiment, the surface of the support plate 56 of the support and containment assemblage 14 can be provided with a texture to aid in bonding to the bond layer 16. In a variant of this embodiment, the texture of the metal plate can serve the purpose of the mesh of the bonding layer.

Referring again to FIGS. 7A-C, in operation when a projectile impacts the strike face assemblage (in the direction of arrow 18), the projectile punches a hole through the strike face assemblage, the bonding layer, and the support and containment assemblage. The containment element 58 bulges outwardly at the site of the impact, pulling the edges toward the center of the bulging. See FIG. 7B. The stitching 62 follows this movement without shearing. As the containment element continues to deform, the full containment element bulges, and the edges rotate. See FIG. 7C. The stitching allows the edges to rotate without peeling or unduly overstressing the stitching.

Figure 13A:
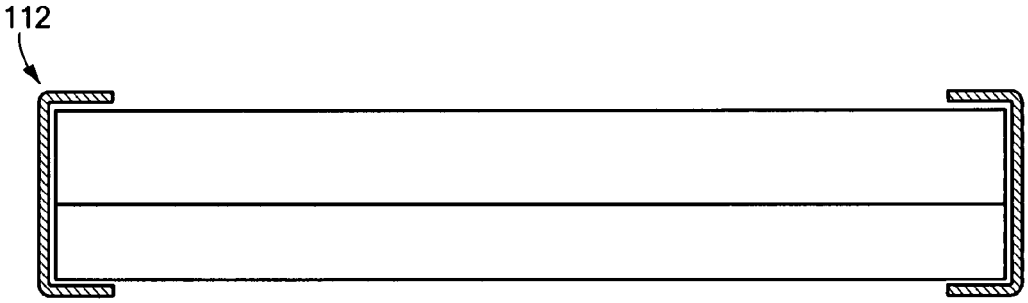
FIGS. 13A and B illustrate a further embodiment of fastening the support plate and the containment element.
Figure 13B:
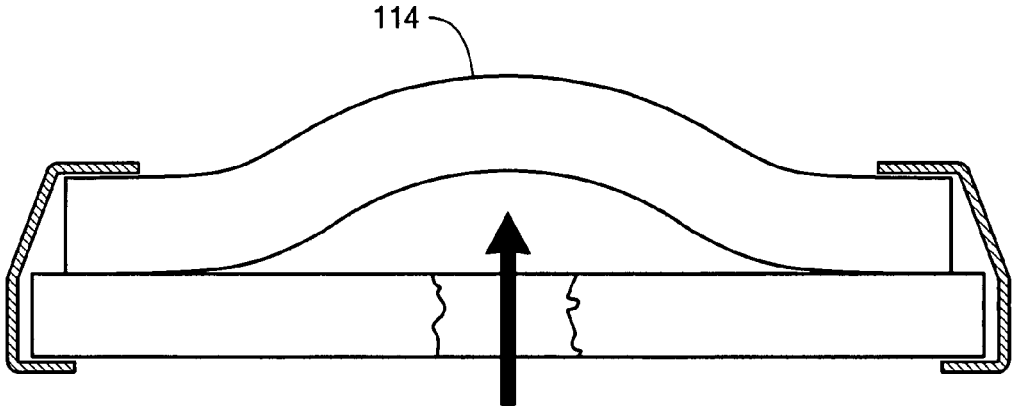

The support panel and containment element can be attached along their periphery in other ways. For example, in another embodiment, the support panel and containment element are bonded at the edges with C channels or clamps 112. See FIGS. 13A, 13B. In this case, as the containment element bulges at the site of impact, the edges of the containment element pull toward the impact 114, peeling off the C channel, rendering it less effective. In addition, it is difficult to get enough bond area to provide substantial support. However, this embodiment is more simple to manufacture and may be satisfactory depending on the application.

Figure 14A:
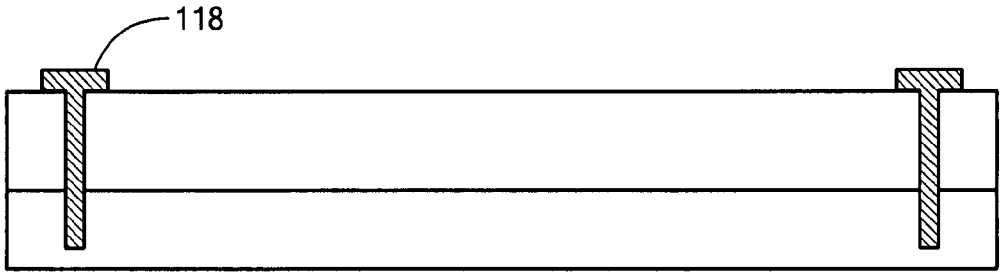
FIGS. 14A and B illustrate a still further embodiment of fastening the support plate and the containment element.
Figure 14B:
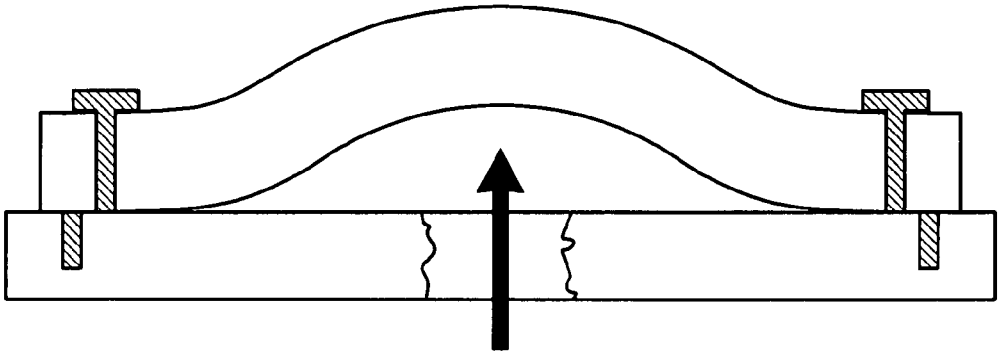

In another embodiment, the support panel and the containment element are fastened with bolts 118 near the edges. See FIGS. 14A, 14*b*. Upon impact, the containment element bulges at the site of impact, and the edges are pulled toward the impact, shearing off the bolts. The bolts can even become projectiles themselves. Thus, this embodiment is suitable primarily for lesser loadings or for ease of manufacture.

Figure 15A:
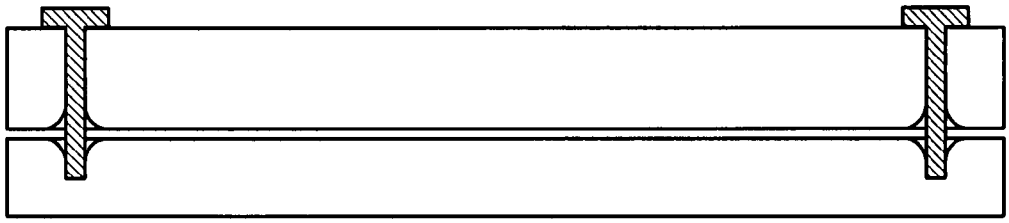
FIGS. 15A and B illustrate a still further embodiment of fastening the support plate and the containment element.
Figure 15B:
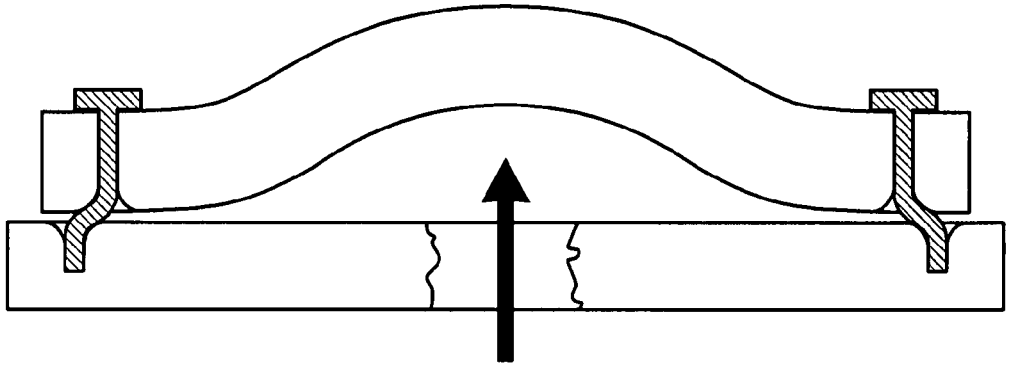

In a still further embodiment, the openings for the bolts can be rounded over in both the support panel and the containment element. See FIGS. 15A, 15B. This allows the bolts to bend as the edges move toward the impact site, postponing failure to a higher load. In a further variant, the threads on the bolts can be eliminated from the deformable region.

Preferably, the strike face assemblage 12 is formed independently of the bonding layer 16 and the support and containment assemblage 14, in any suitable manner. A pultrusion process is suitable. Similarly, the support and containment assemblage is formed independently of the strike face and the bonding layer. Thereafter, the mesh of the bonding layer is placed on the support and containment assemblage. Resin is applied to the mesh, and the strike face assemblage laid on the mesh. Under heat and pressure, the resin in the bonding layer cures, bonding the strike face assemblage to the support and containment assemblage.

The invention is not to be limited by what has been particularly shown and described, except as indicated by the appended claims.

What is claimed is:

1. A support and containment assemblage for an armor panel system having a strike face, the assemblage comprising: a support plate comprising a metal or composite material plate, the support plate including a periphery; a containment element comprising a laminate of fiber reinforced composite material, the containment element including a periphery coextensive with a majority of the periphery of the support plate, the containment element fastened to the support plate with stitching around the periphery of the support plate and the periphery of the containment element, a portion of the containment element within the stitching free to deform away from the support plate to catch and contain fragments when the assemblage is impacted by a projectile; sets of aligned openings in the support plate and the containment element; and notches in edges of the support plate and the containment element, wherein the stitching extends through the aligned openings in the support plate and the containment elements and further extends through the notches in the edges of the support plate and the containment element.

2. The support and containment assemblage of claim 1, wherein the support plate is comprised of steel, aluminum, titanium, carbon/epoxy, glass/epoxy, or glass/polyester.

3. The support and containment assemblage of claim 1, wherein the stitching is formed from a rope or cord of ultra high molecular weight fibers.

4. The support and containment assemblage of claim 1, wherein edges of the openings and the notches are rounded.

5. The support and containment assemblage of claim 1, wherein the stitching comprises multiple ropes or cords, one rope or cord secured through each set of aligned openings.

6. The support and containment assemblage of claim 1, wherein the stitching comprises multiple ropes or cords, one rope or cord secured through two or more sets of aligned openings.

7. The support and containment assemblage of claim 1, wherein the stitching is knotted through aligned openings in the support plate and the containment element.

8. The support and containment assemblage of claim 1, wherein the stitching is secured with a knot or combination of knots.

9. The support and containment assemblage of claim 8, wherein the knots include a half hitch.

10. The support and containment assemblage of claim 1, further comprising stitching disposed in an interior portion of the containment element and support plate.

11. The support and containment assemblage of claim 1, further comprising an interior opening in the support and containment assemblage, further stitching extending around the opening.

12. The support and containment assemblage of claim 1, wherein the laminate comprises a plurality of layers, each layer having fibers aligned in a different direction from fibers of an adjacent layer.

13. The support and containment assemblage of claim 1, wherein the laminate is comprised of ultra high molecular weight polyethylene fibers embedded in a matrix material.

14. An armor panel system including the support and containment assemblage of claim 1, and further comprising:

a strike face comprising a hard material layer; and a bonding layer joining the strike face and the support and containment assemblage.

* * * * *

UNITED STATES PATENT AND TRADEMARK OFFICE

CERTIFICATE OF CORRECTION

PATENT NO. : 8,006,605 B2
APPLICATION NO. : 11/973888
DATED : August 30, 2011
INVENTOR(S) : George C. Tunis et al.

It is certified that error appears in the above-identified patent and that said Letters Patent is hereby corrected as shown below:

On the Title Page, Item (73) Assignee, "Hardware, LLC" should read --Hardwire, LLC--.

Signed and Sealed this
Eighth Day of May, 2012

David J. Kappos

David J. Kappos
*Director of the United States Patent and Trademark Office*